United States Patent [19]

Larws

[11] 4,376,351

[45] Mar. 15, 1983

[54] WHEEL

[76] Inventor: Peter Larws, Schlappmühler Pfad 13, 6390 Usingen, Fed. Rep. of Germany

[21] Appl. No.: 294,047

[22] Filed: Aug. 18, 1981

[30] Foreign Application Priority Data

Sep. 2, 1980 [DE] Fed. Rep. of Germany ..... 3032969

[51] Int. Cl.[3] ..... A63H 33/04; A63H 17/26

[52] U.S. Cl. ..... 46/23; 46/221

[58] Field of Search ..... 46/23–29, 46/221, 17, 16, 1 R

[56] References Cited

U.S. PATENT DOCUMENTS

| | | | |
|---|---|---|---|
| 1,281,832 | 10/1918 | Post | 46/29 |
| 1,707,691 | 4/1929 | Sweet | 46/29 |
| 2,722,772 | 11/1955 | Steanes | 46/29 |
| 2,833,082 | 5/1958 | Carson | 46/23 |
| 3,233,358 | 2/1966 | Dehm | 46/23 X |
| 3,552,056 | 1/1971 | Meates | 46/29 |

FOREIGN PATENT DOCUMENTS

| | | | |
|---|---|---|---|
| 328947 | 5/1930 | United Kingdom | 46/221 |

*Primary Examiner*—Mickey Yu

*Attorney, Agent, or Firm*—Quaintance & Murphy

[57] ABSTRACT

A wheel for use in a construction system of building bricks in the form of the letter "H". This system is based on an arbitrary standard dimension "a". The wheel has a rim and a hub and optionally a ring surrounding the rim. The wheel is provided with axially extending grooves. The specified dimensions make the wheel especially advantageous for use with the system.

6 Claims, 5 Drawing Figures

WHEEL

This invention relates to a wheel for use in a construction system of building bricks. The bricks employed in this system are in the form of the letter "H". The system is based upon an arbitrary standard dimension "a". Basic elements of this system are described in DE-PS No. 2,161,913 and in U.S. Pat. No. 2,278,327. The system is especially useful as a child's toy.

Heretofore, this system has been limited to static structures. Now, however, in accordance with the present invention, there is provided a novel wheel that can be employed in this system and can be combined with other construction elements of the system to make the system mobile and extraordinarily versatile.

Figure 2:
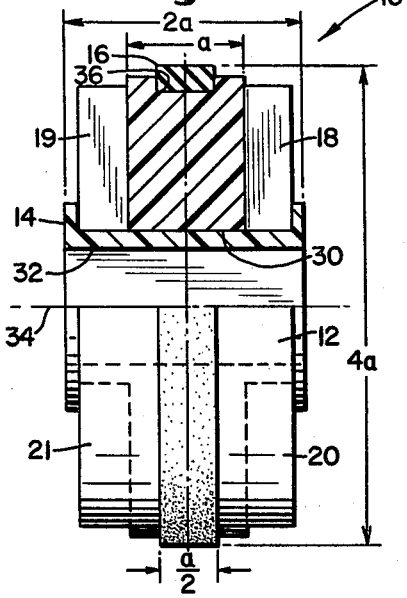
Figure 1:
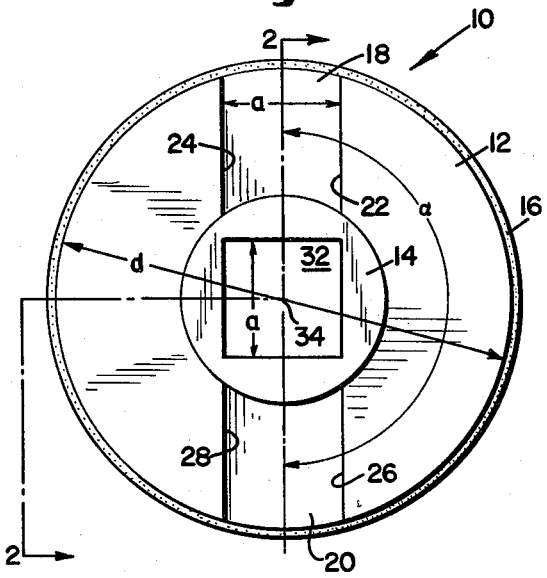
Figure 4:
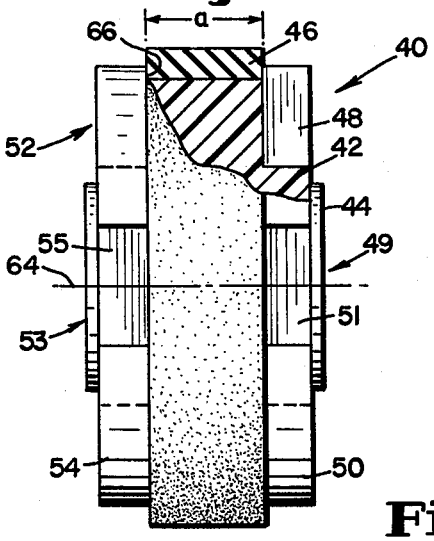
Figure 3:
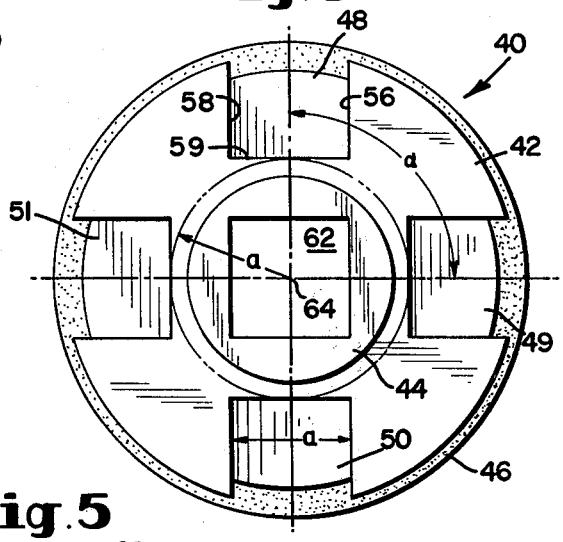
Figure 5:
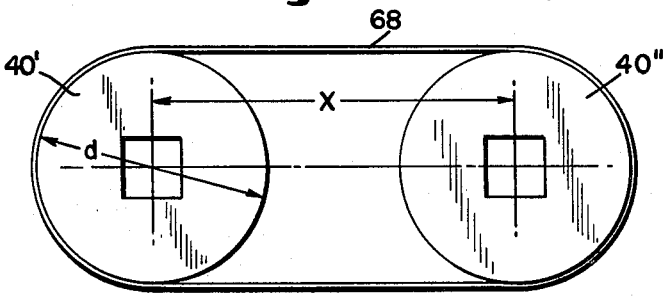

The invention may be better understood by reference to the following drawings wherein:

FIG. 1 is a view of a preferred embodiment of the wheel of the present invention; and FIG. 2 is a sectional view taken along Line 2—2 of FIG. 1; and FIG. 3 is an alternative embodiment of the wheel of the present invention; and FIG. 4 is a partially cut-away view of the wheel of FIG. 3; and FIG. 5 shows two wheels of the present invention in combination with a belt.

Referring now to the drawings and in particular FIGS. 1 and 2, there is shown a wheel 10 of the present invention. The wheel 10 comprises a rim 12, a hub 14 and optionally a ring 16.

The rim 12 has a diameter "d" of $12a/\pi$. The rim 12 has four axially extending grooved 18, 19, 20, 21. The grooves 18, 20 are equally spaced around the circumference of the rim 12 such that the angle "$\alpha$" is equal to 360° divided by the number of grooves or $360°/2=180°$. The groove 18 has two opposing sides 22, 24. The distance between the sides 22, 24 is "a". Furthermore, the sides 22, 24 are parallel to each other. The groove 20 is provided with sides 26, 28 of similar structure. The grooves 19, 21 also have similar structure.

The rim 12 is provided with an axial opening 30. This axial opening 30 is axial to the rim 12, is cylindrical and extends completely through the rim 12. Within the axial opening 30 is the hub 14. The hub 14 is rotatably mounted in the axial opening 30. The hub 14 has a square opening 32 having dimensions "a" by "a". The axis 34 is the center of the axial opening 30; is the center of the square opening 32 and is the axis of rotation of the wheel 10.

The wheel 10 is also optionally provided with a rim 16. The rim 16 fits in a circumferential groove 36. Significant dimensions of the wheel 10 are shown in FIGS. 1 and 2 referring to the arbitrary standard "a".

Referring now to FIGS. 3 and 4, there is shown an alternative embodiment in the form of the wheel 40 of the present invention. The wheel 40 is provided with a rim 42, a hub 44 and optionally a ring 46. The rim 42 has eight axially extending grooves 48, 49, 50, 51, 52, 53, 54 and 55. The structure of the axially extending groove 48 is representative. The groove 48 has opposing sides 56, 58. These sides 56, 58 are parallel to each other and are spaced from each other by a distance "a". The radially innermost surface 59 of the groove 48 is spaced from the axis 64 a distance "a". The grooves 49, 50, 51, 52, 53, 54 and 55 have similar structure. As will be apparent by reference to FIG. 3, the angle "$\alpha$" shown thereon is equal to 90°. The hub 44 of the wheel 40 is provided with a rectangular opening 62. The ring 46 is fixedly attached to the rim 42 to a circumferential groove 66 in the manner shown.

By reference to FIG. 5, an advantageous combination of wheels of the present invention with a belt can be seen. Two wheels 40', 40'' identical in structure to the wheel 40 are arranged in combination with a belt 68. The belt 68 fits in the groove 66 shown in FIG. 4.

The wheel of the present invention can be made of any suitable material such as metal or plastic. However, the rims and hubs are preferably of relatively hard plastic whereas the rings are preferably of elastomeric plastic.

What is claimed is:

1. A wheel for use in a construction system of building bricks in the form of the letter "H" which system is based on an arbitrary standard dimension "a"; said wheel comprising:

A. A rim having two opposing sides and a diameter of $12a/\pi$, said rim having a plurality of axially extending and radially aligned grooves on each side of the rim, equally spaced around the circumference of the rim; each of said grooves having opposing sides spaced from each other by the distance "a"; said rim having an axial cylindrical opening; and B. a hub rotatably mounted in the axial cylindrical opening of the rim; said hub having an axially disposed square opening having dimensions "a" by "a";

wherein the wheel has a width 2a.

2. The wheel of claim 1 wherein each axially extending groove has an innermost surface which is spaced a distance "a" from the axis of rotation of the wheel.

3. The wheel of claim 1 having a ring fixed to its periphery wherein the outside diameter of the ring is 4a.

4. The wheel of claim 3 wherein the width of the ring is a/2.

5. The wheel of claim 3 wherein the width of the ring is "a".

6. A wheel for use in a construction system of building bricks in the form of the letter "H" which system is based on an arbitrary standard dimension "a"; said wheel comprising:

A. a rim having two opposing sides and a diameter of $12a/\pi$, said rim having a plurality of axially extending and radially aligned grooves on each side of the rim, equally spaced around the circumference of the rim; each of said grooves having opposing sides spaced from each other by the distance "a"; said rim having an axial cylindrical opening; and B. a hub rotatably mounted in the axial cylindrical opening of the rim; said hub having an axially disposed square opening having dimensions "a" by "a"; and C. a ring surrounding the rim fixedly held in a circumferential groove in the rim; and wherein the wheel has a width 2a; and wherein each axially extending groove has an innermost surface which is spaced a distance "a" from the axis of rotation of the wheel.

* * * * *